US012760612B2

(12) United States Patent
Nyberg et al.

(10) Patent No.: US 12,760,612 B2
(45) **Date of Patent: *Oct. 13, 2026**

(54) EXTENDED REACH TOOL FOR A BOTTOM HOLE ASSEMBLY

(71) Applicant: KLX ENERGY SERVICES LLC, Houston, TX (US)

(72) Inventors: Ryan Nyberg, Houston, TX (US); Robert Stratton, Tomball, TX (US); John D. McClure, Magnolia, TX (US)

(73) Assignee: KLX ENERGY SERVICES LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/227,930

(22) Filed: Jun. 4, 2025

(65) Prior Publication Data

US 2025/0297523 A1 Sep. 25, 2025

Related U.S. Application Data

(63) Continuation of application No. 18/375,737, filed on Oct. 2, 2023, now Pat. No. 12,366,131.

(60) Provisional application No. 63/533,795, filed on Aug. 21, 2023, provisional application No. 63/526,881, filed on Jul. 14, 2023, provisional application No. 63/413,775, filed on Oct. 6, 2022.

(51) Int. Cl.

| | |
|---|---|
| ***E21B 31/00*** | (2006.01) |
| ***E21B 4/02*** | (2006.01) |
| ***E21B 21/10*** | (2006.01) |

(52) U.S. Cl.

CPC ..... *E21B 31/005* (2013.01); *E21B 4/02* (2013.01); *E21B 21/10* (2013.01)

(58) Field of Classification Search

CPC . E21B 4/02; E21B 7/24; E21B 31/005; E21B 21/10

See application file for complete search history.

(56) References Cited

U.S. PATENT DOCUMENTS 10,865,612 B2 * 12/2020 Elfar ..... E21B 21/103

* cited by examiner

*Primary Examiner* — Robert E Fuller
(74) *Attorney, Agent, or Firm* — McAfee & Taft

(57) ABSTRACT

A downhole tool comprises a tool housing defining a flow passage therethrough from a first to a second end thereof. A poppet is axially movable on a poppet mandrel positioned in the tool housing. The poppet mandrel has at least one outlet port defined therein. A pilot valve is rotatable about the poppet mandrel. Rotation of the pilot valve opens and closes the at least one outlet port in the poppet mandrel to permit and block flow therethrough, and wherein the opening and closing of the at least one outlet port moves the poppet axially on the poppet mandrel.

21 Claims, 6 Drawing Sheets

EXTENDED REACH TOOL FOR A BOTTOM HOLE ASSEMBLY

CROSS REFERENCE TO RELATED APPLICATIONS

This application is a continuation of U.S. Non-Provisional application Ser. No. 18/375,737 filed on Oct. 2, 2023, now allowed, which claims priority to U.S. Provisional Application No. 63/533,795 filed on Aug. 21, 2023, U.S. Provisional Application No. 63/526,881 filed on Jul. 14, 2023, and U.S. Provisional Application No. 63/413,775 filed on Oct. 6, 2022, which are all incorporated herein.

BACKGROUND

In the drilling and completion industry, wellbores are drilled to significant depths for the purpose of production and/or injection of fluids, including hydrocarbons. Oftentimes frictional forces between the tubing being lowered into the well and the casing or formation wall are such that it is difficult to reach the required depth. In some cases, the tubing may actually lock up, such that the snubbing force applied from the surface is unable to overcome the frictional forces. Extended reach tools are utilized to assist in overcoming the frictional forces.

DETAILED DESCRIPTION

Figure 1:
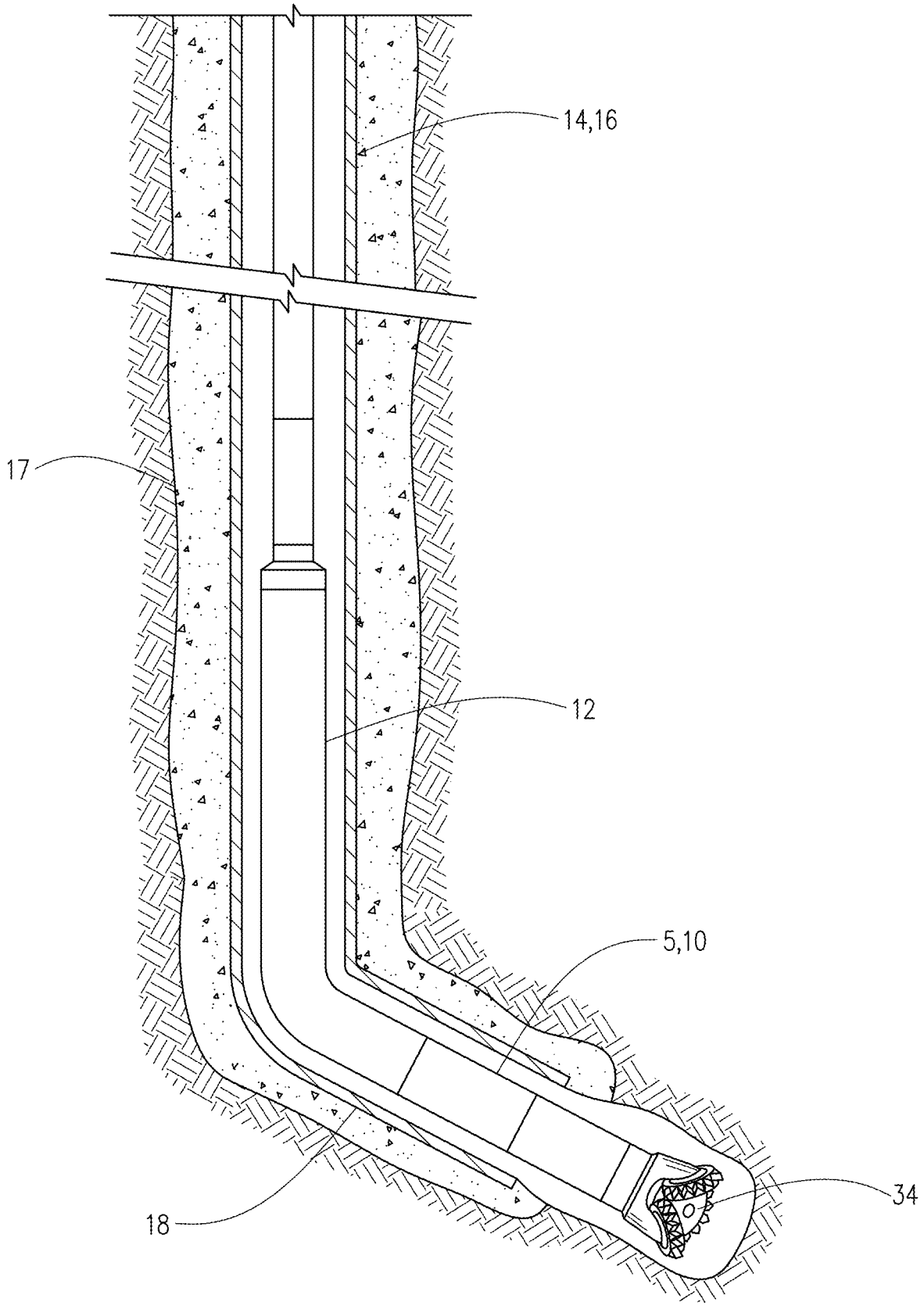
FIG. 1 is a schematic of a well with a drill string including the downhole tool of the current disclosure.
Figure 2A:
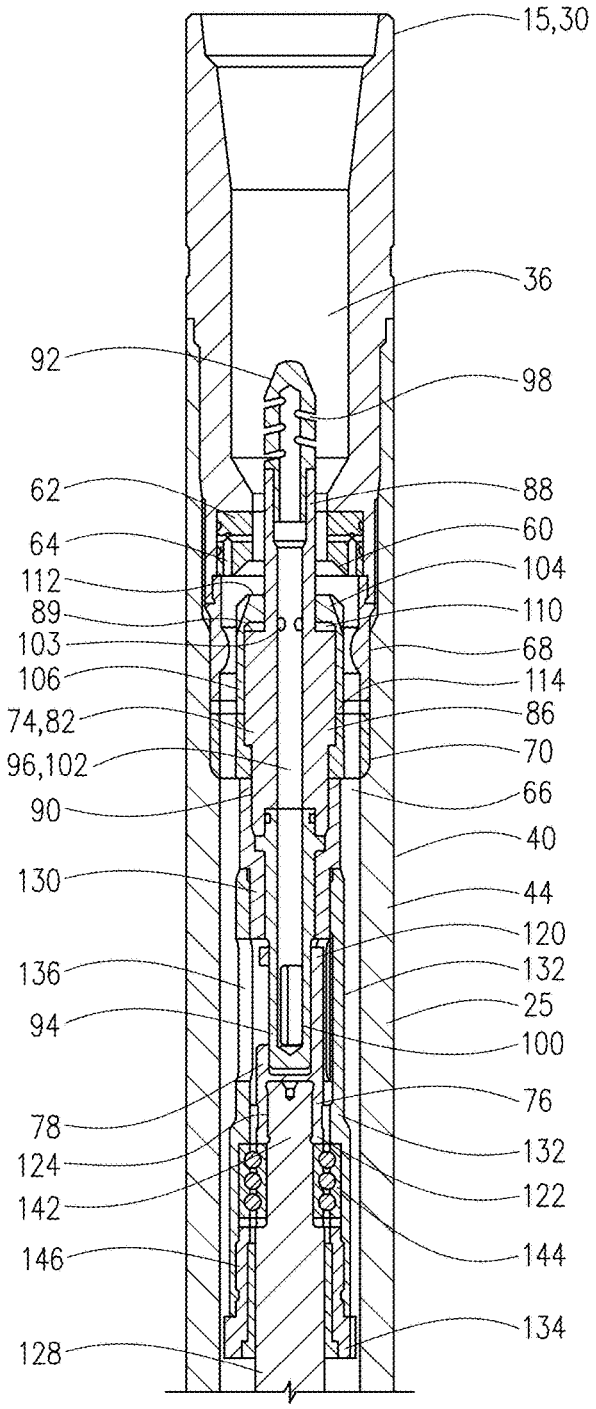
FIGS. 2A-2D depict a sectional view of the downhole tool.
Figure 2B:
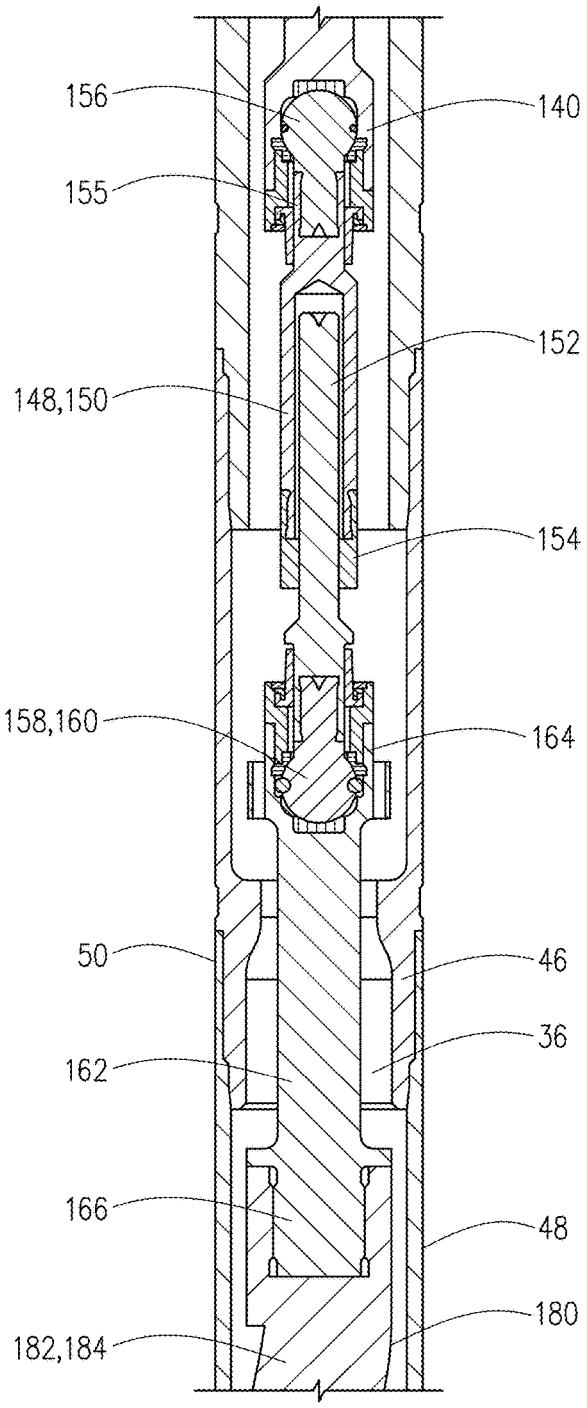
Figure 2C:
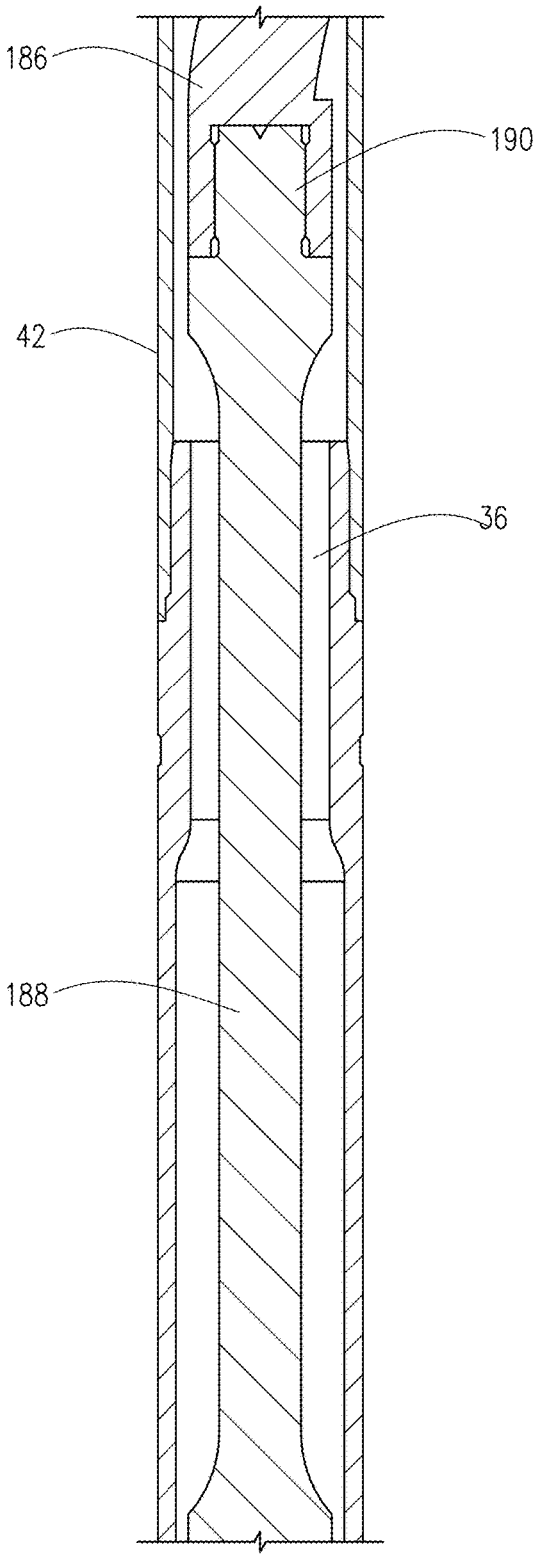
Figure 2D:
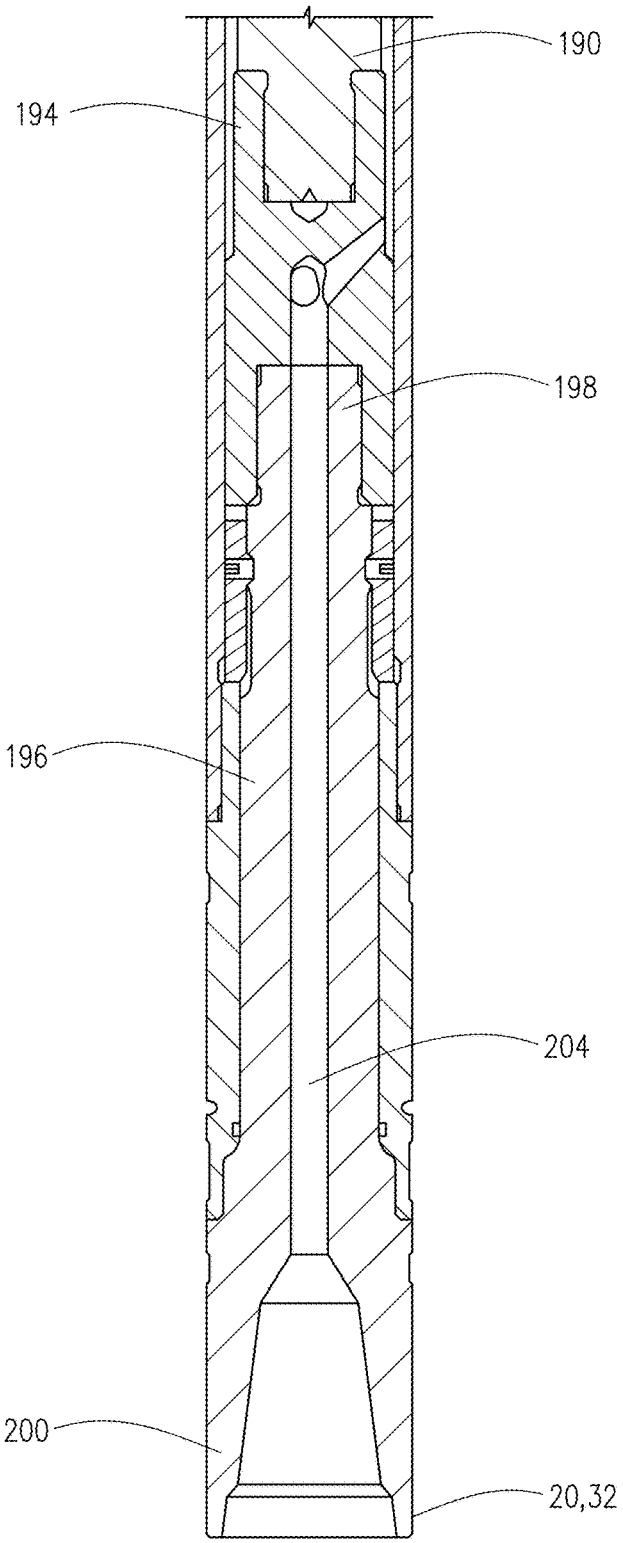

The drawings included with this application illustrate certain aspects of the embodiments described herein. However, the drawings should not be viewed as exclusive embodiments. The subject matter disclosed is capable of considerable modifications, alterations, combinations, and equivalents in form and function, as will occur to those skilled in the art with the benefit of this disclosure.

The present disclosure may be understood more readily by reference to these detailed descriptions. For simplicity and clarity of illustration, where appropriate, reference numerals may be repeated among the different figures to indicate corresponding or analogous elements. The following description is not to be considered as limiting the scope of the embodiments described herein. The drawings are not necessarily to scale and the proportions of certain parts may have been exaggerated to better illustrate details and features of the present disclosure. Also, the phraseology and terminology employed herein are for the purpose of description and should not be regarded as limiting except where indicated as such.

Throughout this disclosure, the terms "about," "approximate," and variations thereof, are used to indicate that a value includes the inherent variation or error for the device, system, or measuring method being employed as recognized by those skilled in the art.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "downhole," "downstream," or other like terms shall be construed as generally away from the surface, regardless of the wellbore orientation. Use of any one or more of the foregoing terms shall not be construed as denoting positions along a perfectly vertical axis. A wellbore can include vertical, inclined or horizontal portions, and can be straight or curved.

The disclosed downhole tool 10 provides improved movement of drill strings through a borehole. Downhole tool 10 as shown in the FIGS. is suitable for use in drill strings in the form of coiled tubing or drill strings of solid tubulars. Both types of drill strings are commonly used in hydrocarbon production. When used with coiled tubing, downhole tool 10 is configured for incorporation into the bottom hole assembly (BHA) 5 commonly used in such drill strings. When used with tubulars, the downhole tool 10 is configured for incorporation at one or more of the joints between the tubulars. Tool 10 is shown lowered on a drill string 12, which in one embodiment may be a coiled tubing into a wellbore 14. Wellbore 14 may have a casing 16 therein but also may be an open hole wellbore. The downhole tool 10 may be used in vertical or deviated wells which like wellbore 14 have a vertical section 17 and a deviated section 18. Although in the disclosed embodiment downhole tool 10 is depicted as lowered on a coiled tubing with a drill bit at an end thereof, it is understood that the downhole tool 10 may be conveyed into the well on jointed pipe as well, and may be any pipe or tubing such as a completion string, logging string, drill string or other type of string or piping employed in a downhole operation.

In one embodiment, downhole tool 10 includes a first, or upper end 15 and a second, or lower end 20. Downhole tool 10 comprises tool housing 25 that has first, or upper end 30 and second or lower end 32. In the described embodiment, the upper and lower ends of downhole tool 10 are coincident with the upper and lower ends of tool housing 25. First and second ends 30 and 32 may be configured either for attachment within a BHA 5 or as part of a joint between tubulars making up a traditional drill string. In one embodiment a drill bit 34 is connected to lower end 32.

A fluid passageway 36 extends through housing 25 from first end 30 to second end 32 and provides a path for drilling mud or other fluid to pass through downhole tool 10. Fluid passageway 36 may be comprised of a plurality of fluid paths as will be described in detail herein.

Downhole tool 10 comprises an upper, or valve section 40 connected to a lower, or drive section 42. In the described embodiment drive section 42 comprises a mud motor assembly. Valve section 40 comprises a valve body 44 with lower end 46 connected to an upper end 50 of mud motor housing 48. Tool housing 25 defines a valve seat 60, which may be defined on an insert 62 fixed to valve body 44. A fluid path 64, which comprises a portion of fluid passageway 36 may be defined in tool housing 25, and specifically in insert 62. Fluid path 64 is an optional feature and when included fluid path 64 communicates with an annulus 66 that likewise comprises a portion of fluid passageway 36. A choke sleeve 68 and a valve centralizer 70 may be positioned in tool housing 25.

Also located within tool housing 25 is a fluid flow control valve 74 and a pilot valve 76. Pilot valve 76 is in one embodiment a rotatable pilot valve 76 that is operable to cycle the fluid flow control valve 74 between open and closed positions. In one embodiment pilot valve 76 is a generally cup-shaped cylindrical valve with one or more ports 78 in an outer wall 80 thereof. In the disclosed embodiment, there are two pilot valve exit ports 78 spaced 180° apart.

Fluid flow control valve 74 in one embodiment comprises a poppet valve with poppet mandrel 82 and a poppet 84 that is slidable relative to poppet mandrel 82. An annular space 75 is defined between choke sleeve 68 and poppet 84. Poppet mandrel 82 comprises a mandrel body 86 and a reduced diameter mandrel neck 88. An upward facing shoulder 89 is defined by and between poppet mandrel body 86 and mandrel neck 88. Poppet mandrel 82 has outer surface 90, an upper end 92 and a lower end 94. A longitudinal flow passage 96 is defined through poppet mandrel 82 and receives fluid through access ports 98 in mandrel neck 88. A plurality of radial outlet ports 100 are defined in poppet mandrel 82 at the lower end 94 thereof. In the disclosed embodiment there are two radial outlet ports 100 spaced 180° apart. While the disclosed embodiment shows two radial outlet ports, one port, or other numbers of ports are possible. The number of radial outlet ports 100 and the frequency of rotation of pilot valve 76 will be determinative of the pressure pulse frequency generated by downhole tool 10. In the open position of the fluid flow control valve 74 fluid will enter access ports 98 and will flow through longitudinal flow passage 96 and exit through outlet flow ports 100 and exit ports 78 in pilot valve 76 into annulus 66, which is a part of fluid passageway 36. Longitudinal flow passage 96 and outlet flow ports 100 comprise a flow path 102 that is likewise a part of fluid passageway 36. Flow path 102 is closed when flow control valve 74 is in the closed position.

A plurality of radially directed ports 103 are defined through a wall of poppet mandrel 82 and specifically through mandrel neck 88. Poppet 84 comprises a poppet head 104 with a generally cylindrical wall 106 extending therefrom. Poppet 84 thus defines a cavity 108 in which poppet mandrel 82 is received. A space 110 is defined between upward facing shoulder 89 and poppet head 104. Poppet 84 has first, or upper end 112 and second, or lower end 114. As described in more detail below, when pilot valve 76 is in an open position, fluid in tool housing 25 is permitted to flow through longitudinal central flow passage 96 and radial outlet ports 100 in fluid flow control valve 74 into annulus 66. Poppet 84 is slidable relative to poppet mandrel 82. When pilot valve 76 rotates to the closed position, shutting off flow through radial outlet ports 100, fluid will flow through radially directed ports 103 into space 110, and will urge poppet 84 upwardly to engage valve seat 60. In this position, flow though flow path 102 is impeded, but flow through the downhole tool 10 is permitted through flow path 64 into annular space 75 and annulus 66.

Pilot valve 76 has first, or upper end 120 and second or lower end 122. Second end 122 has internal threads 124 to connect to a rotating pilot mandrel 128. Pilot valve exit ports 78 are defined in wall 80 of pilot valve 76. Pilot valve 76 may be a rotating cylindrical valve that is rotated by the drive section 42. Pilot valve 76 controls operation of fluid flow control valve 74. However, pilot valve 76 does not have a direct mechanical linkage to fluid flow control valve 74. Rather, pilot valve 76 controls the fluid flow through downhole tool 10 and fluid flow control valve 74 thereby managing the operation of fluid flow control valve 74. In the described embodiment fluid flow control valve 74 is a poppet valve which lacks a return spring such that the operation of fluid flow control valve 74 is controlled solely by fluid pressure as regulated by pilot valve 76.

In one embodiment poppet mandrel 82 may be a two-piece mandrel connected together with a mandrel adapter 130. A slotted mandrel 132 is connected at one end to mandrel adapter 130 and at a second end to a slotted mandrel retaining cap 134. Slotted mandrel 132 has a plurality of slots 136 defined therethrough to allow flow into annulus 66 of fluid passageway 36 when fluid flow control valve 74 is in the open position. An annular space 137 is defined between pilot valve 76 and slotted mandrel 132. Fluid that exits ports 78 in pilot valve 76 will pass into annular space 137 and then through slots 136 into fluid passageway 36. The disclosed embodiment includes five slots 136, but more or less slots can be used. Rotating pilot mandrel 128 has lower end 140 and upper end 142. Pilot valve 76 is connected at its lower end 122 to the upper end 142 of rotating mandrel 128. Rotating pilot mandrel 128 may be disposed in roller bearings 144 and radial bearings 146 to provide for rotation thereof.

A drive shaft 148, which may be a two-piece drive shaft with upper and lower drive shaft sections 150 and 152 is connected to rotating mandrel 128. Drive shaft sections 150 and 152 may be connected with a torque sleeve 154. Torque sleeve 154 and drive shaft sections 150 and 152 are configured to allow limited relative axial movement while being rotationally locked. An upper end 155 of drive shaft 148 is a ball end 156 that is connected in a manner known in the art such that rotation of drive shaft 148 rotates rotating mandrel 128. A plurality of spherical balls are positioned in openings in ball end 156 and extend into rotating mandrel 128. Such an arrangement is known in the art and provides for sufficient play to accommodate the eccentricity of a mud motor rotor, while still providing a rotatable connection. A lower end 158 of drive shaft 148 is a ball end 160 that is connected to a rotor catch bolt 162 at its upper end 164. Rotor catch bolt 162 is connected at its lower end 166 to drive section 42.

Drive section 42 comprises mud motor housing 48 and has a power section 180. Power section 180 comprises a rotor and stator 182 and 184 of a type known in the art. Rotor 182 and stator 184 are not shown in detail, but such components are known and understood. Rotor catch bolt 162 is fixed to the rotor 182, so that rotation of the rotor 182 will rotate rotor catch bolt 162 and drive shaft 148 which in turn rotates rotating mandrel 128. A lower end 186 of rotor 182 is connected to an upper end 190 of a motor shaft 188. Motor shaft 188 has lower end 192 connected to a coupling 194. Coupling 194 is connected to a bit mandrel 196 at its upper end 198 thereof. A lower end 200 of bit mandrel 196 may be connected to a drill bit 34. Bit mandrel 196 has an axial flow passage 204 defined therethrough.

Figure 3:
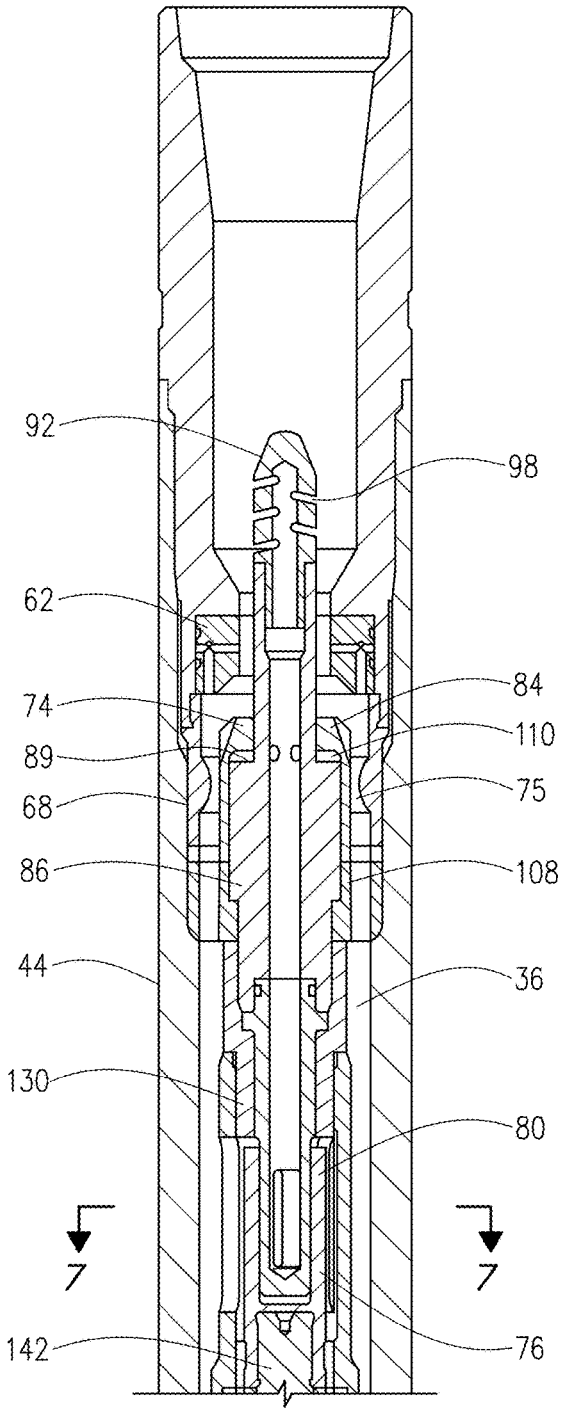
FIGS. 3-6 are section views depicting the cycling of the fluid control valve of the downhole tool between the closed and open positions.
Figure 4:
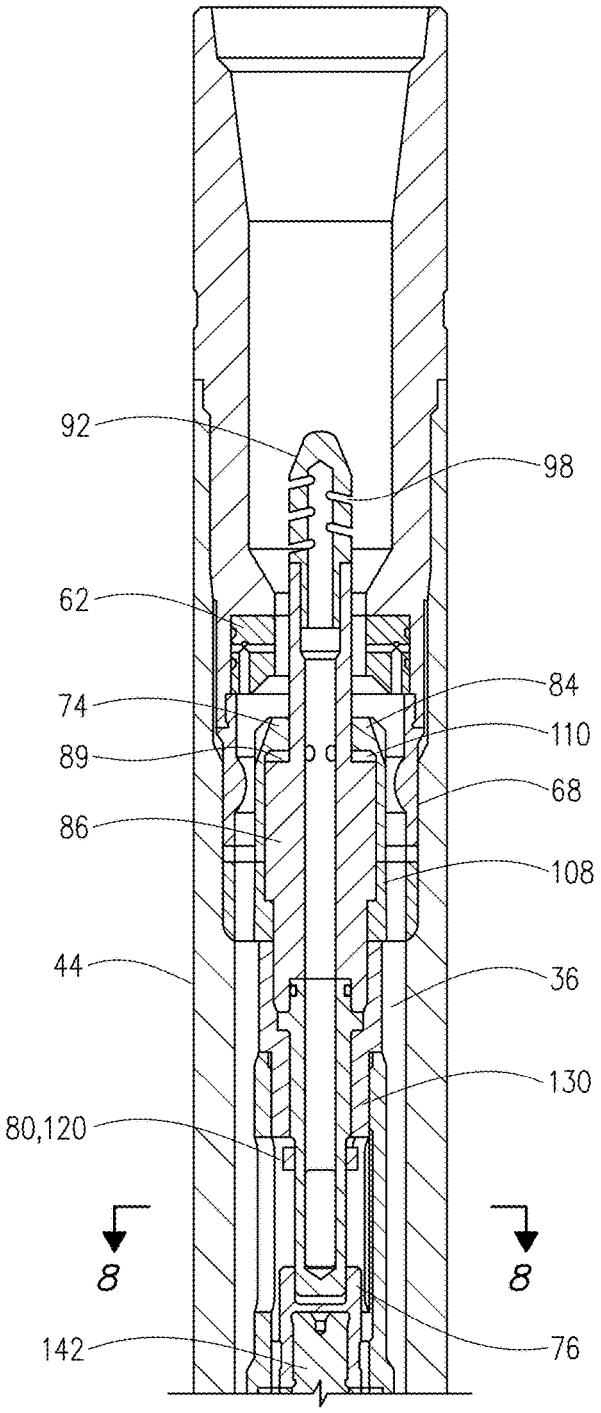

Fluid passageway 36 begins at first end 15 and passes through downhole tool 10, and into axial flow passage 204. Fluid flowing through downhole tool 10 will rotate bit mandrel 196 and drill bit 34 and will also rotate pilot valve 76 through the connection therewith. Thus, pilot valve 76 and fluid flow control valve 74 are both operated though the rotation of rotor 182 and driven solely by the flow of fluid through downhole tool 10. With reference to FIGS. 3 and 4, with pilot valve 76 in the closed position, flow through the lower end of poppet mandrel 82 is blocked. As a result, fluid flow through radial outlet ports 100 is blocked, and fluid begins to flow into radially directed ports 103. The fluid is trapped however, so the pressure on the bottom, i.e., downstream or distal end, of poppet 84 of fluid flow control valve 74 is greater than pressure on the top side, i.e., upstream or proximal end, of fluid flow control valve 74. The imbalanced fluid pressure drives poppet 84 of fluid control valve 74 upwards until it engages fluid flow control valve seat 60. Thus, with pilot valve 76 in the closed position, fluid flow control valve 74 is held in the closed position. As reflected in FIGS. 3-6, fluid path 64 in tool housing 25 provides for continuous flow into annulus 66 and through fluid passageway 36 in downhole tool 10. When pilot valve 76 is open, flow through radial outlet ports 100 is permitted and the pressure on the bottom of poppet 84 of fluid flow control valve 74 is less than pressure on the top side of poppet 84 of fluid flow control valve 74. The resulting imbalance of fluid pressure drives the poppet 84 downwardly towards the lower end of downhole tool 10, i.e., the open position.

Figure 5:
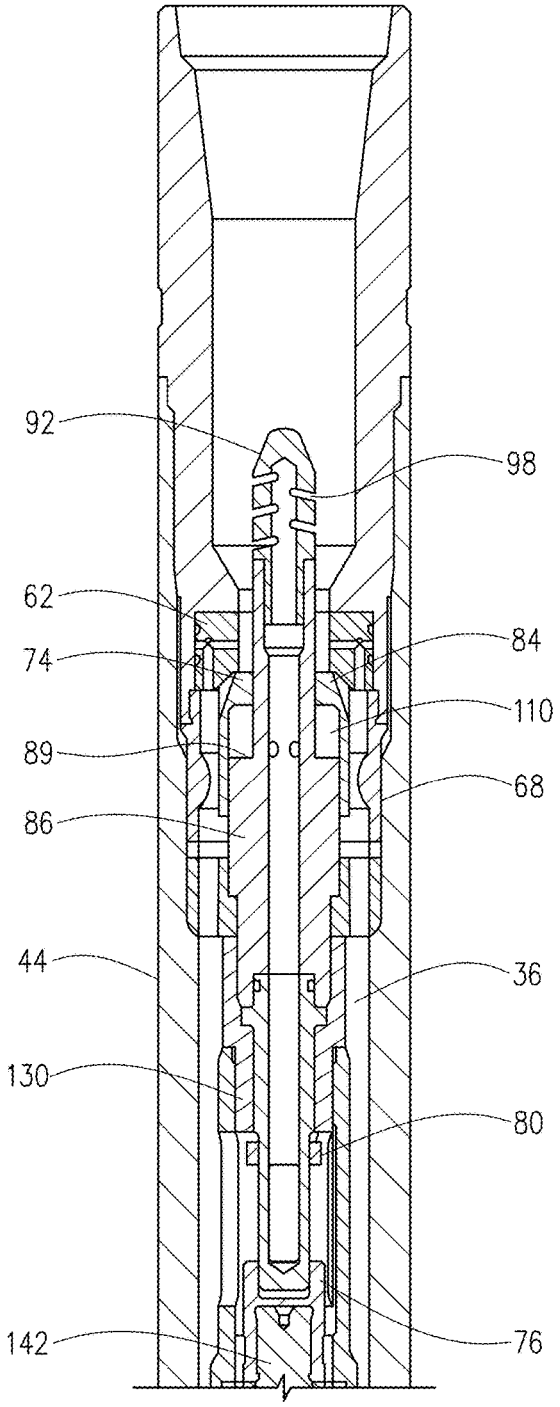
Figure 6:
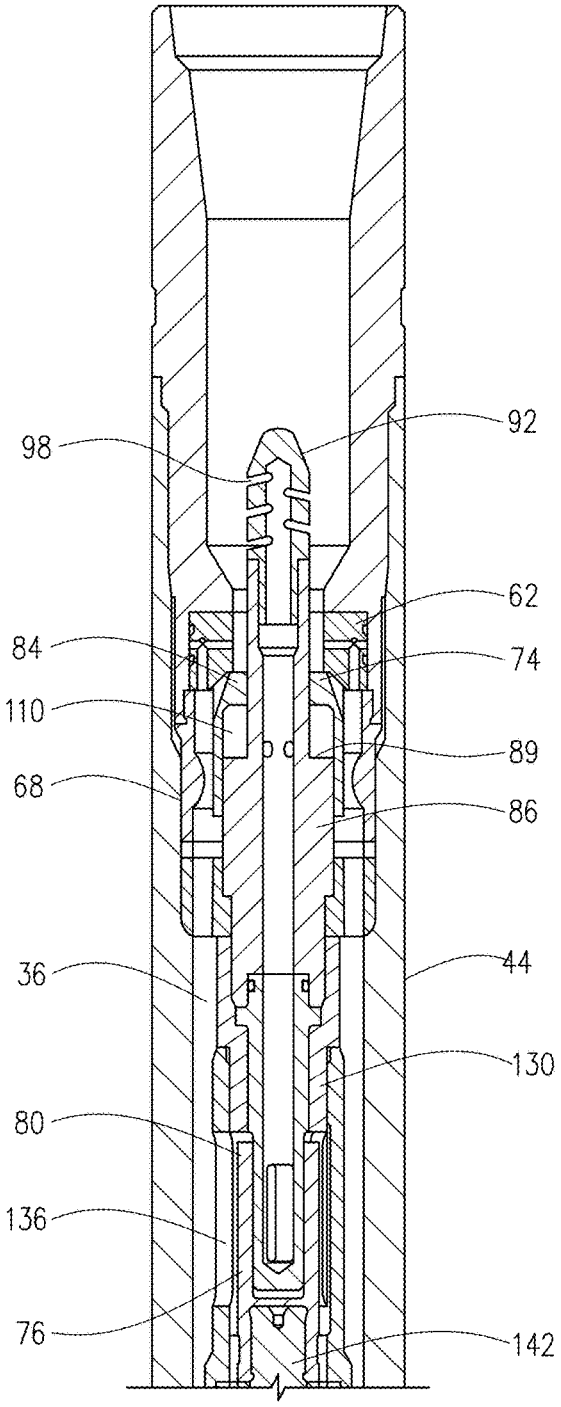
Figure 7:
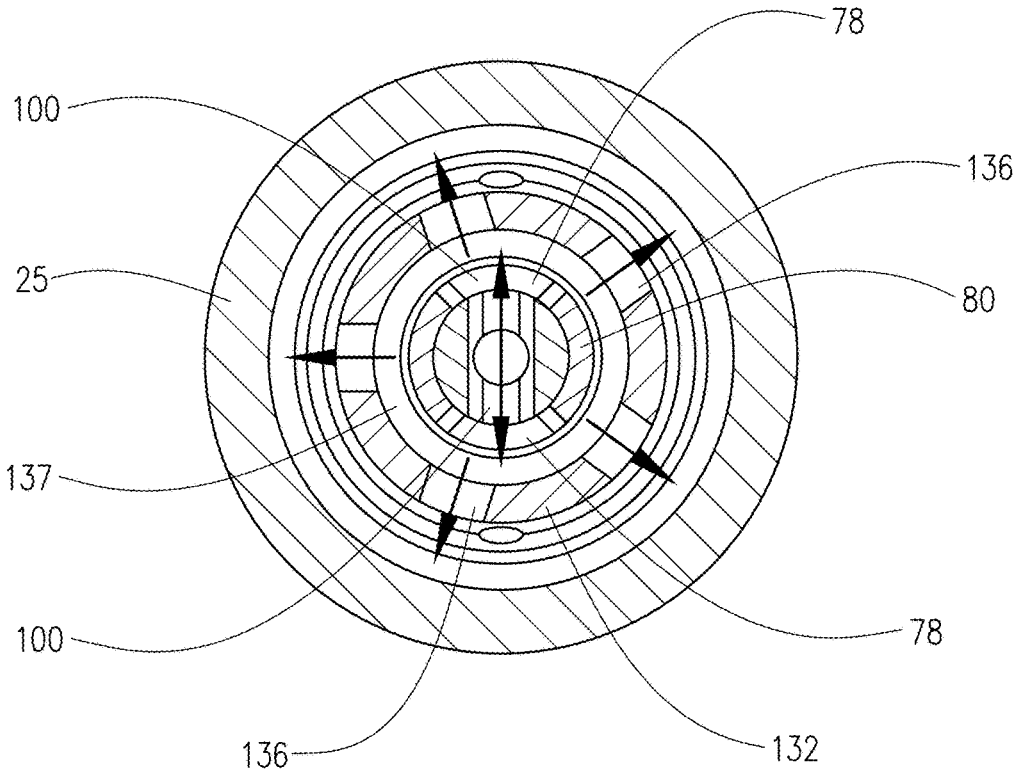
FIGS. 7 and 8 correspond to section lines 7-7 and 8-8 of FIGS. 3 and 4, respectively.
Figure 8:
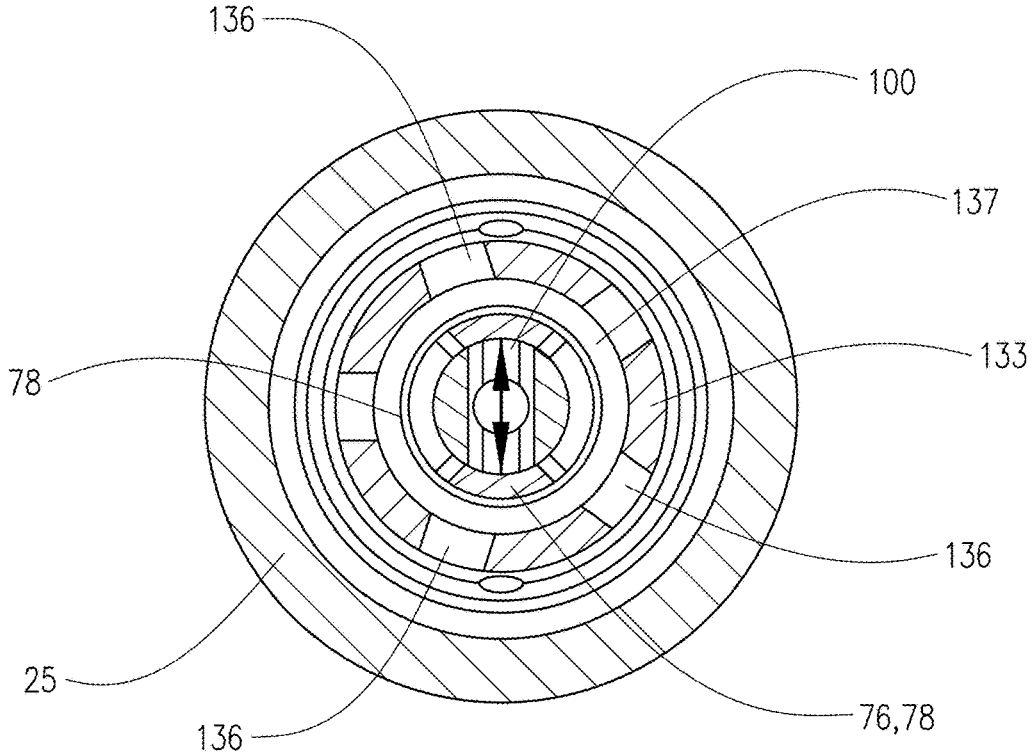

Fluid flow control valve 74 is configured to move between an open position as depicted in FIG. 3 and a closed position as depicted in FIG. 5. FIGS. 3-6 are representative of the sequence of operations that occur when the fluid flow control valve 74, and thus the downhole tool 10 cycle between open and closed positions. When the pilot valve 76 is open, as shown in FIG. 3, fluid flow control valve 74 is likewise open. To move the fluid flow control valve 74 to the closed position, pilot valve 76 is moved to the closed position as shown in FIG. 4. FIG. 4 shows the fluid flow control valve 74 still in the open position. As soon as pilot valve 76 moves to the closed position fluid flow control valve 74 will move to its closed position as shown in FIG. 5. FIG. 6 shows the pilot valve 76 rotated to the open position. When this occurs, fluid flow control valve 74 will move back to the open position shown in FIG. 3.

Thus, use of downhole tool 10 provides an improved method for running drill string into a borehole. When the drill string is coiled tubing, downhole tool 10 will be included in BHA 5. As known to those skilled in the art, BHA 5 is located at the distal end of the drill string. Downhole tool 10 may be located anywhere within BHA 5. When the drill string is made up of conventional tubular pipe, downhole tool 10 may be located at one or more joints between adjacent tubulars. Downhole tool 10 may be used in connection with any number of downhole processes, including, in non-limiting examples, drilling operations for drilling out frac plugs or other drilling operations. In such a case a drill bit 34 will be connected to the coiled tubing or other string below the downhole tool 10. Although downhole tool 10 may be used in drilling operations, downhole tool 10 may be used in connection with other operations, including, in non-limiting examples, fishing and cleanout operations.

During the insertion process, one or more pumps located either at the surface or in the drill string at locations above BHA 5 force working fluid through the drill string. In the initial insertion, the working fluid will be pumped through passageway 36 in downhole tool 10, and flow through drive section 42. The fluid flowing therethrough will rotate rotor 182 which will rotate rotating mandrel 128, and drive shaft 148. Drive shaft 148 will rotate pilot valve 76 which will cycle the flow control valve 74 between open and closed positions. The downhole tool 10 will experience cyclic pressure changes generated by the cyclic opening and closing of the flow control valve 74. There is a consequent stiffening and relaxing of the tool 10, which will assist in overcoming friction that may occur when the tool 10 is lowered into a wellbore. The speed of rotation of the pilot valve 76 can be managed by changing the flow rate of the fluid flowing through the downhole tool. The higher the flow rate, the faster the speed of rotation of rotor 182 and pilot valve 76 through the connection with rotor 182. Thus, the faster the flow rate, the more rapid the cycling between open and closed positions of the fluid flow control valve 74. The fluid flow control valve 74 will rotate continuously so long as fluid as being pumped through downhole tool 10.

In the open position of the fluid flow control valve 74 and pilot valve 76 fluid flows through longitudinal central flow passage 96 of fluid flow control valve 74, through radial outlet ports 100 and pilot valve ports 78 which are aligned with ports 100. Fluid flows from pilot valve ports 78 into annular space 137 and through slots 136 in slotted mandrel 132. As the pilot valve 76 rotates from the open to the closed positions, a misalignment between radial exit ports 100 and pilot valve exit ports 78 occurs and flow is blocked therethrough. Poppet 84 is urged upwardly into valve seat 60. This cycle is repeated as fluid flows through the downhole tool 10. Continued rotation of pilot valve 76 will realign radial outlet ports 100 and pilot valve ports 78 allowing flow therethrough and releasing the upward fluid pressure applied to poppet 84. Poppet 84 will slide downwardly on poppet mandrel 82 and move to the open position of fluid flow control valve 74. Fluid flow control valve 74 will cycle between the open and closed positions at a constant rate, which may be for example at a rate between about 1 to 8 cycles per second. More typically, the cycle rate of fluid flow control valve 74 will be between about 3 to 8 cycles per second with the most likely cycle rate being between 3 to 5 cycles per second. Lower cycle rates per second will increase the pressure associated with each cycle. Conversely, higher cycle rates per second will lower the pressure associated with each cycle. The cycling between open and closed positions to permit and restrict flow generates vibrations, or axial oscillations to assist in overcoming friction.

Although the described embodiment is directed to the use of a mud motor to provide rotation to pilot valve 76, other rotational drives are possible. In an additional embodiment a motor dedicated solely to the rotation of the pilot valve could be used. Likewise, a dedicated turbine or similar rotational drive with fins, blades or other configurations that will generate rotation when fluid passes thereover may be used. In any case, the rotational drive will rotate the pilot valve 76 which will cycle the poppet so that it reciprocates on the poppet mandrel and moves between open and closed positions is described. The cycling between open and closed positions creates a vibratory effect to assist in overcoming any friction experienced when the downhole tool 10 is lowered into a wellbore. The foregoing operational steps apply equally to the alternative embodiment configurations of downhole tool 10. Additionally, the described operational steps are equally applicable to removal or retrieval of coiled tubing and tubular type drill stings from a borehole. Thus, operation of downhole tool 10 in accordance with the foregoing methods applies to both insertion and retrieval operations.

Embodiments include:

Embodiment 1. A downhole tool comprising a tool housing defining a fluid passageway from a first to a second end thereof, a fluid flow control valve movable between open and closed positions in the tool housing, wherein cycling the valve between the open and closed positions causes the downhole tool to axially oscillate; and a mud motor assembly comprising a rotor and a stator connected to the tool housing, the flow passage communicated with an interior of the mud motor assembly, wherein rotation of the mud motor rotor cycles the fluid flow control valve between open and closed positions.

Embodiment 2. The downhole tool of embodiment 1, the fluid passageway comprised of a plurality of flow pathways, the fluid flow control valve operable to close one of the plurality of flow pathways in the closed position of the fluid flow control valve.

Embodiment 3. The downhole tool of embodiment 2, the fluid flow control valve defining one of the flow pathways, wherein fluid flow through the flow pathway in the fluid flow control valve is restricted when the fluid flow control valve is in the closed position.

Embodiment 4. The downhole tool of any of embodiments 1-3, the fluid flow control valve comprising a poppet reciprocable on a poppet mandrel between the closed position in which the poppet engages the tool housing and diverts the flow of fluid in the tool housing and the open position in which fluid flows around the poppet and through the poppet and poppet mandrel.

Embodiment 5. The downhole tool of embodiment 4, wherein rotation of the rotor reciprocates the poppet on the poppet mandrel.

Embodiment 6. The downhole tool of any of embodiments 1-5 further comprising a pilot valve positioned in the housing and rotatable relative to the fluid flow control valve; and a drive shaft connected to the pilot valve and connected to and rotated by the rotor, wherein rotation of the drive shaft rotates the pilot valve, and wherein rotation of the pilot valve opens and closes the fluid flow control valve.

Embodiment 7. The downhole tool of embodiment 6, the fluid flow control valve defining a flow pathway therethrough communicated with a plurality of radial outlet ports wherein rotation of the pilot valve opens and closes the radial outlet ports in the fluid flow control valve which causes the fluid flow control valve to move between open and closed positions.

Embodiment 8. The downhole tool of either of embodiments 6 or 7, the fluid flow control valve comprising a poppet movable on a poppet mandrel, the poppet mandrel having the radial outlet ports defined therethrough, the poppet being urged upwardly to engage an inner surface of the tool housing in the closed position of the fluid flow control valve when the pilot valve rotates to close the radial outlet ports in the poppet mandrel.

Embodiment 9. A downhole tool comprising a tool housing defining a flow passage from a first to a second end thereof; a fluid flow control valve axially movable between open and closed positions in the tool housing, wherein cycling the fluid flow control valve between the open and closed positions causes the downhole tool to axially oscillate; a rotatable pilot valve operable to open and close the fluid flow control valve; and a rotational drive connected to the pilot valve to rotate the pilot valve, the rotational drive being rotated by fluid flowing through the downhole tool.

Embodiment 10. The downhole tool of embodiment 9, wherein rotation of the pilot valve opens and closes a fluid path through the fluid flow control valve to cause the fluid flow valve to move between open and closed positions.

Embodiment 11. The downhole tool of embodiment 10, the fluid flow control valve comprising a poppet reciprocably positioned on a poppet mandrel, wherein rotation of the pilot valve reciprocates the poppet on the poppet mandrel between open and closed positions.

Embodiment 12. The downhole tool of any of embodiments 9-11, the rotational drive comprising a mud motor.

Embodiment 13. The downhole tool of embodiment 12, further comprising a drill bit connected to the mud motor, wherein the mud motor rotates the drill bit and the rotatable pilot valve.

Embodiment 14. The downhole tool of any of embodiments 9-13, wherein the pilot valve rotates at a constant rate.

Embodiment 15. A downhole tool comprising a tool housing defining a flow passage therethrough from a first to a second end thereof, a poppet axially reciprocable on a poppet mandrel positioned in the tool housing, the poppet mandrel having at least one outlet port defined therein; a pilot valve rotatable about the poppet mandrel, wherein rotation of the pilot valve opens and closes the at least one outlet port in the poppet mandrel to permit and block flow therethrough, and wherein the opening and closing of the at least one outlet port moves the poppet axially on the poppet mandrel.

Embodiment 16. The downhole tool of embodiment 15, wherein the poppet is urged upwardly on the poppet mandrel into engagement with a seat in the tool housing when the pilot rotates to close the at least one outlet port in the poppet mandrel.

Embodiment 17. The downhole tool of either of embodiments 15 or 16, further comprising a rotational drive positioned in the tool housing connected to the pilot valve.

Embodiment 18. The downhole tool of embodiment 17, the rotational drive comprising a mud motor.

Embodiment 19. The downhole tool of embodiment 18, further comprising a drill bit at a lower end of the downhole tool, wherein the mud motor is rotated by fluid flowing through the tool housing, and the mud motor rotates the drill bit and the pilot valve.

Embodiment 20. The downhole tool of any of embodiments 16-19, wherein reciprocating the poppet into and out of engagement with the seat in the tool housing causes the downhole tool to axially oscillate.

Embodiment 21. The downhole tool of any of embodiments 15-20, further comprising a tool string connected to the tool housing, wherein the opening and closing of the at least one outlet in the poppet mandrel generates vibrations in the tool string.

Other embodiments of the present invention will be apparent to one skilled in the art. As such, the foregoing description merely enables and describes the general uses and methods of the present invention. Accordingly, the following claims define the true scope of the present invention.

What is claimed is:

1. A downhole tool comprising:

a tool housing defining a fluid passageway for a fluid flow from a first to a second end of the tool housing;

a fluid flow control valve movable in the tool housing between an open position in which flow through the fluid flow valve is permitted and a closed position in which flow through the fluid flow control valve is restricted, wherein cycling the fluid flow control valve between the open and closed positions to permit and restrict flow therethrough causes the downhole tool to axially oscillate, the fluid flow control valve comprising;

a poppet; and a poppet mandrel, the poppet being reciprocable on the poppet mandrel to move the fluid flow control valve between the closed position and the open position solely as a result of fluid pressure acting on the poppet;

and a mud motor assembly comprising a rotor and a stator connected to the tool housing, the fluid passageway communicated with an interior of the mud motor assembly.

2. The downhole tool of claim 1, the fluid passageway comprised of a plurality of flow pathways, the fluid flow control valve operable to close one of the plurality of flow pathways in the closed position of the fluid flow control valve.

3. The downhole tool of claim 2, the fluid flow control valve defining one of the flow pathways, wherein fluid flow through the flow pathway in the fluid flow control valve is restricted when the fluid flow control valve is in the closed position.

4. The downhole tool of claim 1, wherein in the closed position the poppet engages the tool housing and diverts the flow of fluid in the tool housing and in the open position fluid flows around the poppet and through the poppet mandrel.

5. The downhole tool of claim 4, wherein rotation of the rotor causes the poppet to reciprocate on the poppet mandrel.

6. The downhole tool of claim 1, further comprising:

a pilot valve positioned in the housing and rotatable relative to the fluid flow control valve; and a drive shaft connected to the pilot valve and connected to and rotated by the rotor, wherein rotation of the drive shaft rotates the pilot valve, and wherein rotation of the pilot valve causes a change in the fluid pressure acting on the poppet to cycle the fluid flow control between the open and closed positions.

7. The downhole tool of claim 6, wherein the fluid flow control valve defines a flow pathway therethrough communicated with a plurality of radial outlet ports and wherein rotation of the pilot valve opens and closes the radial outlet ports in the fluid flow control valve.

8. The downhole tool of claim 1, wherein rotation of the mud motor rotor generates a change in the fluid pressure acting on the poppet to cycle the fluid flow control valve between the open and closed positions.

9. A downhole tool comprising:

a tool housing defining a flow passage for a fluid flow from a first to a second end of the tool housing;

a fluid flow control valve movable between open and closed positions in the tool housing, wherein cycling the fluid flow control valve between the open and closed positions to permit and restrict fluid flow causes the downhole tool to axially oscillate, the fluid flow control valve comprising;

a poppet; and a poppet mandrel, the poppet being reciprocable on the poppet mandrel;

a pilot valve rotatably disposed about the poppet mandrel; and a rotational drive connected to the pilot valve to rotate the pilot valve, the rotational drive being rotated by fluid flowing through the downhole tool, wherein the poppet is reciprocated on the poppet mandrel solely as a result of fluid pressure acting on the poppet.

10. The downhole tool of claim 9, wherein rotation of the pilot valve opens and closes a fluid path through the fluid flow control valve and causes the poppet to reciprocate on the poppet mandrel between the closed position of the fluid flow control valve in which the poppet engages the tool housing and diverts the flow of fluid in the tool housing and the open position of the fluid flow control valve in which fluid flows around the poppet and through the poppet mandrel.

11. The downhole tool of claim 10, wherein rotation of the pilot valve generates a changing fluid pressure to reciprocate the poppet on the poppet mandrel.

12. The downhole tool of claim 9, wherein the rotational drive comprises a mud motor.

13. The downhole tool of claim 12, further comprising a drill bit connected to the mud motor, wherein the mud motor rotates the drill bit and the rotatable pilot valve.

14. The downhole tool of claim 9, wherein the pilot valve rotates at a constant rate.

15. A downhole tool comprising:

a tool housing defining a flow passage therethrough for a fluid flow from a first to a second end of the tool housing;

a poppet axially movable on a poppet mandrel positioned in the tool housing, the poppet mandrel having at least one outlet port defined therein;

a pilot valve rotatable about the poppet mandrel, wherein rotation of the pilot valve opens and closes the at least one outlet port in the poppet mandrel to permit and block the fluid flow through the mandrel, and wherein the poppet moves axially on the poppet mandrel solely as a result of fluid pressure acting on the poppet.

16. The downhole tool of claim 15, wherein the poppet is urged upwardly on the poppet mandrel into engagement with a seat in the tool housing when the pilot valve rotates to close the at least one outlet port in the poppet mandrel.

17. The downhole tool of claim 16, wherein reciprocating the poppet into and out of engagement with the seat in the tool housing to restrict and permit flow through the at least one outlet port in the poppet mandrel causes the downhole tool to axially oscillate.

18. The downhole tool of claim 15, further comprising a rotational drive positioned in the tool housing connected to the pilot valve.

19. The downhole tool of claim 18, wherein the rotational drive comprises a mud motor.

20. The downhole tool of claim 19, further comprising a drill bit at a lower end of the downhole tool, wherein the mud motor is rotated by fluid flowing through the tool housing, and the mud motor rotates the drill bit and the pilot valve.

21. The downhole tool of claim 15, further comprising a tool string connected to the tool housing, wherein the opening and closing of the at least one outlet in the poppet mandrel to permit and restrict flow therethrough generates vibrations in the tool string.

* * * * *